US007178668B2

(12) United States Patent
Vovan

(10) Patent No.: US 7,178,668 B2
(45) Date of Patent: Feb. 20, 2007

(54) BUNDT CAKE CONTAINER

(75) Inventor: Terry Vovan, Rialto, CA (US)

(73) Assignee: PWP Industries, Vernon, CA (US)

( * ) Notice: Subject to any disclaimer, the term of this patent is extended or adjusted under 35 U.S.C. 154(b) by 342 days.

(21) Appl. No.: 10/875,824

(22) Filed: Jun. 24, 2004

(65) Prior Publication Data

US 2005/0284307 A1 Dec. 29, 2005

(51) Int. Cl.
*B65D 85/02* (2006.01)

(52) U.S. Cl. ..... 206/303; 206/493; 99/428

(58) Field of Classification Search ..... 206/303, 206/493, 551, 308.1, 308.4, 405, 397, 308.2; D7/538, 610, 359; 99/426, 428; 220/574, 220/623, 608, 912; 426/512, 514
See application file for complete search history.

(56) References Cited

U.S. PATENT DOCUMENTS 5,456,379 A * 10/1995 Krupa et al. ..... 220/835
5,685,453 A * 11/1997 Goins et al. ..... 220/782
D478,246 S * 8/2003 Villano et al. ..... D7/359

* cited by examiner

*Primary Examiner*—Mickey Yu
*Assistant Examiner*—Steven A. Reynolds
(74) *Attorney, Agent, or Firm*—Leon D. Rosen

(57) ABSTRACT

A container (10) for holding a bundt cake (12), which avoids an unsightly accumulation of sugar frosting around the central hole in the cake, and which provides strength for stacking containers with cakes therein on top of one another. The container includes a base (14) with a cake-supporting surface (30) and a central upward projection (32) for insertion into the central cake hole, and a cover (16) with a cover top (20) and with side walls (22) that have bottoms (24) that latch to the base. The central upward projection has a plurality of largely vertically extending grooves (40) that allow hot frosting to flow down to a recess (44) lying below the cake-supporting surface. The middle of the cover forms a downwardly-extending post (62) that engages the top of the center projection on the base, to support the cover, especially when containers holding cakes are stacked. The cover periphery has a raised rim portion (80) that fits into a corresponding circular recess space (104) in the lower surface of the base to further help in stacking.

3 Claims, 5 Drawing Sheets

10

BUNDT CAKE CONTAINER

BACKGROUND OF THE INVENTION

A bundt cake has a hole in the middle, which enables more even heating during baking. The cake may be baked by placing it on a conveyor belt that carries it though an oven at perhaps 300° F. As the cake emerges from the oven and has cooled to perhaps 100° F. to 120° F., the cake is sprayed with a largely sugar frosting and placed on a base with a base central projection inserted though the central hole in the cake.

The hot frosting that is still flowable when the cake is placed on the base, tends to accumulate at the intersection of the top of the cake hole and the top of the central projection of the base. This accumulation tends to detract from the appearance of the cake, and it would be desirable to avoid it.

Containers that hold bundt cakes are typically constructed of vacuum formed thin plastic sheet. When the cakes are baked and placed into the containers, the containers are typically stacked on one another. During transport and display, other food containers which may or may not be bundt cake containers, may be stacked on the bundt cake container. A bundt cake container which could support considerable weight without buckling, would be of value.

SUMMARY OF THE INVENTION

In accordance with one embodiment of the invention, a bundt cake container is provided that avoids unsightly accumulation of frosting at the cake central hole, and which strengthens the container to support other containers stacked thereon. The central projection on the base of the bundt cake container, is formed so its periphery has a plurality of largely vertical grooves. Melted frosting that tends to accumulate at the cake hole, flows down along the grooves and into a recess in the base.

The cover that surround a cake on the base, includes a cover top and a cover side with a bottom that latches to the base. The cover top is formed with a downwardly projecting post at its center, which extends down to near the top of the central projection on the base. If a weight is placed on the cover top, as when another container is placed on the cover top, and the cover top begins to deflect downwardly, the weight is transferred from the cover top through the post to the central projection on the base. The central projection has a recess that receives the bottom of the post, to assure that the post does not slide sidewardly off the central projection.

The periphery of the cover forms an upward projection, and the periphery of the base bottom surface form a circular recess that receives the cover peripheral projection, to better stabilize a stack of containers.

The novel features of the invention are set forth with particularity in the appended claims. The invention will be best understood from the following description when read in conjunction with the accompanying drawings.

DESCRIPTION OF THE PREFERRED EMBODIMENTS

Figure 1:
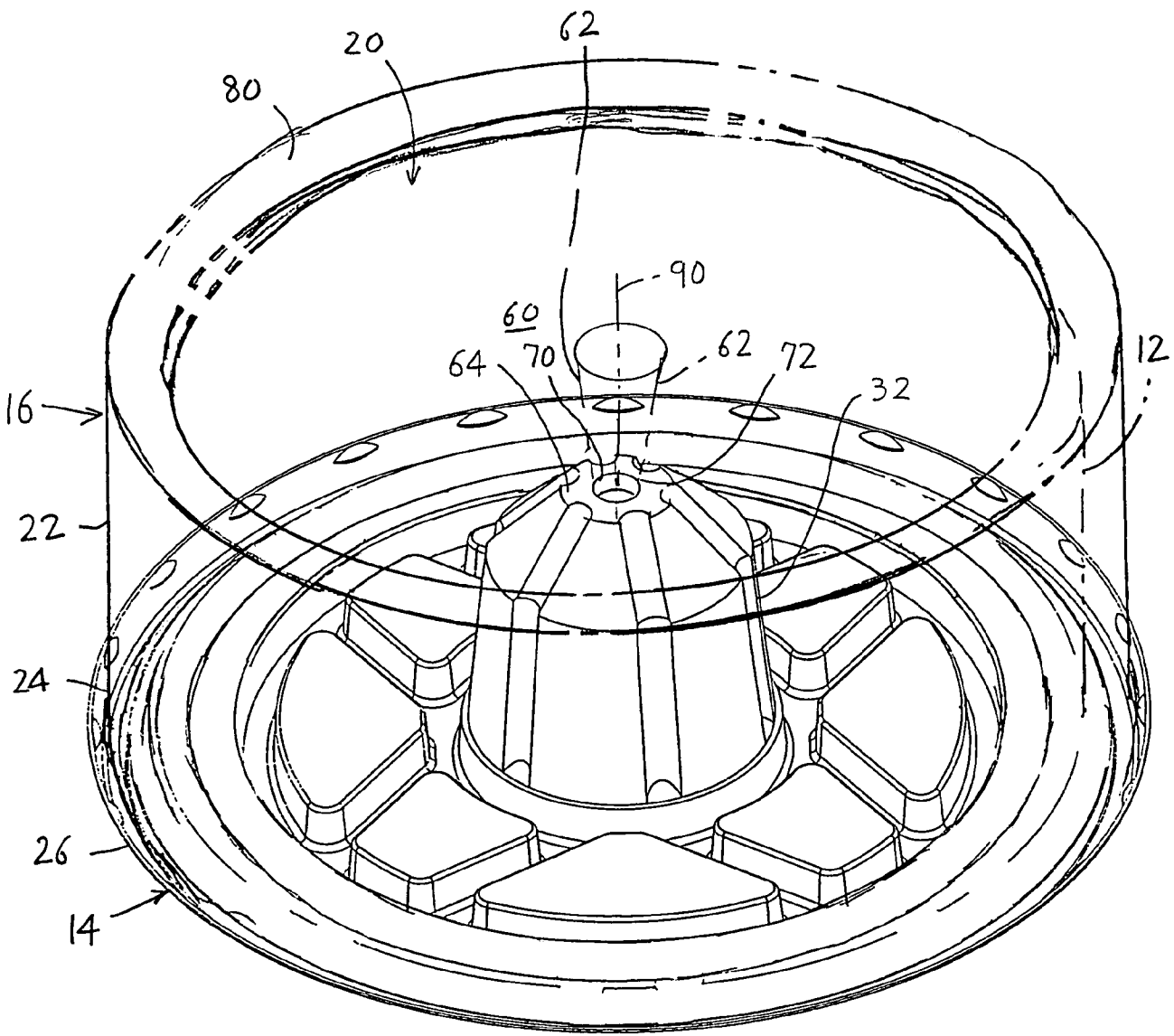
FIG. 1 is an isometric view of a bundt cake container, with the cover being shown in phantom lines.
Figure 2:
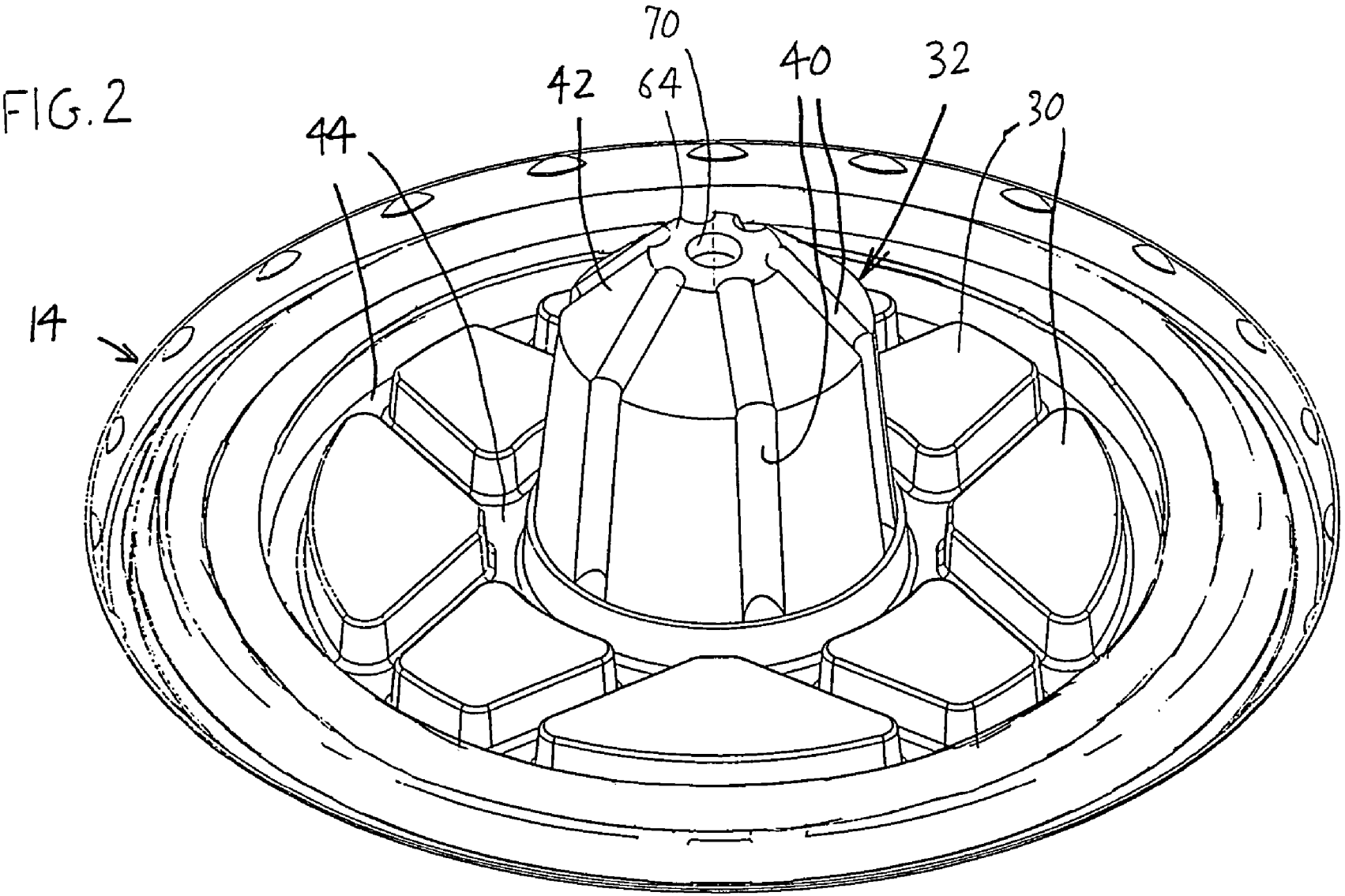
FIG. 2 is an isometric view of only the base of the container of FIG. 1.
Figure 3:
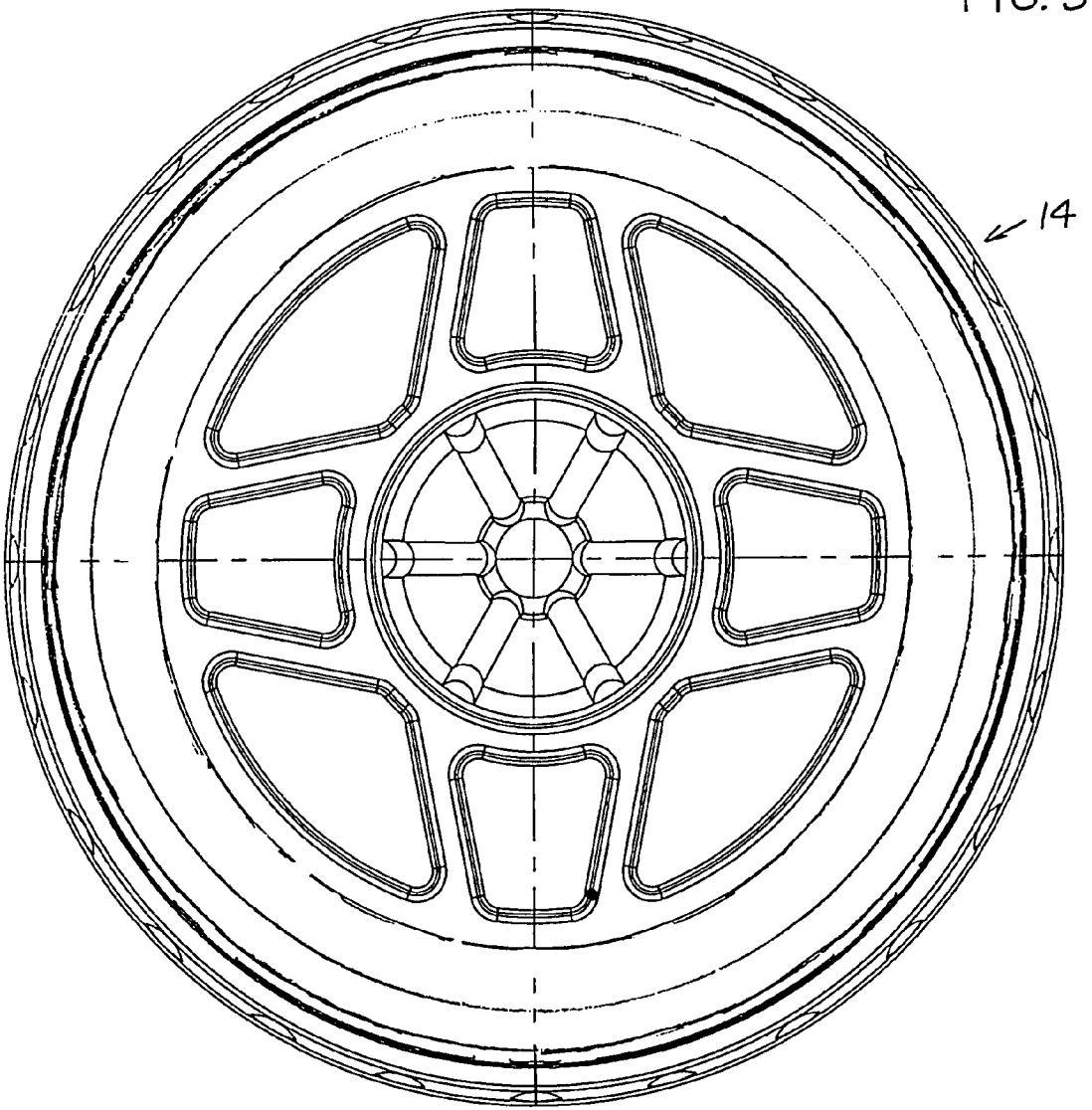
FIG. 3 is a plan view of the base of FIG. 2.

FIG. 1 illustrates a bundt cake container 10 of the present invention which is designed to hold a bundt cake 12, which is a cake that has a vertical hole through its center. A typical bundt cake with an outside diameter of 20 centimeters (8 inches) has a hole of a diameter of about 7.5 centimeters (3 inches). The hole enables more even baking of the cake. The container includes a base 14 that supports the cake and a cover 16 that surrounds the cake. The cover includes a cover top 20 that lies over the cake and cover side walls 22 that surround the cake. A bottom 24 of the cover side walls is connected to a rim 26 of the base. As shown in FIG. 2, the base has a cake-supporting surface 30 and has a central upward projection 32 that extends upward by perhaps 5 centimeters above the cake-supporting surface 30 and that lies closely within the bundt cake hole.

During production of the cake, after it is baked and still hot (e.g. 110° F.), a flavored sugar coating or similar coating is sprayed onto the cake. Any type of cake coating is herein referred to as frosting. With the cake placed on the base 14, the frosting tends to flow and accumulate at the top of its central hole. In the past, this resulted in an uneven circle of accumulated frosting that detracted from the appearance of the bundt cake. In accordance with one feature of the present invention, applicant constructs the central projection 32 with a plurality of largely vertically-extending grooves 40 in the outside of the projection. Frosting that tends to accumulate around the central hole of the cake, flows downward onto a tapered top portion 42 of the central projection, and into one of the grooves 40. The excess frosting flows down along the grooves and into a recess 44 that lies below the cake supporting surface 30.

Figure 4:
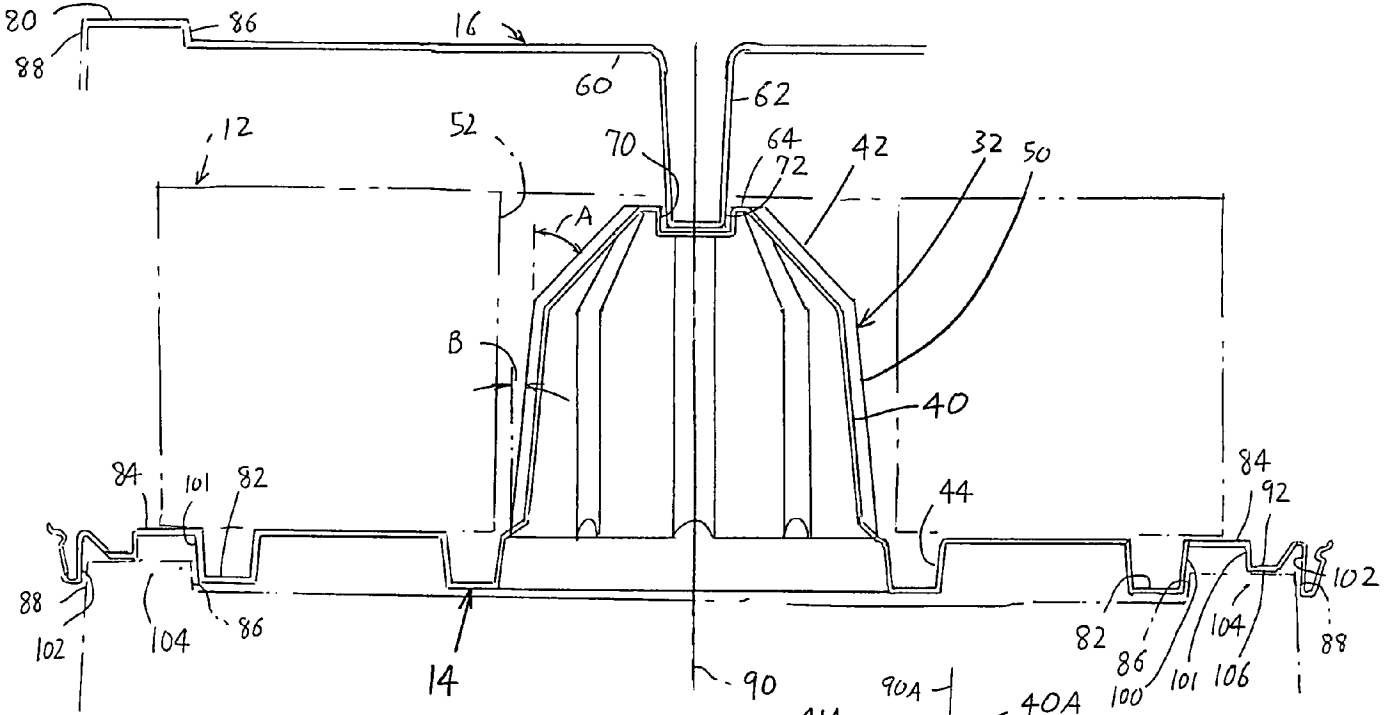
FIG. 4 is a sectional view of the base of FIG. 3, and showing a portion of a cover lying over the base, and also showing in phantom lies a portion of a cover lying under the base.

FIG. 4 shows that the base 14 and cover 16 are each constructed of vacuum formed sheet plastic. The central projection 32 has a moderately tapered top portion 42 which is shown tapered at an angle A to the vertical of about 45°. The lower portion 50 of the central projection is tapered to extend about 8° (4° to 15°) to the vertical to facilitate removal from the vacuum forming mold and to facilitate receiving the walls of the hole 52 in the bundt cake 12. The taper angle A of the portion 42 is at least twice the taper angle B of the lower portion.

FIG. 1 shows that the cover 20 has a cover middle 60 that is downwardly deformed to form a post part 62. The post part extends by about 4 centimeters (1.5 inches) down below the surrounding part of the cover top. The post engages the top 64 of the central projection when the cover top middle 60 is depressed. Applicant prefers to form a recess 70 in the projection top that closely receives the lower end 72 of the post. This prevents the post from sliding sidewardly off the projection top when the cover top is pressed down. In practice, food containers filled with food may be stacked on one another. The post 62 that supports the middle of the sheet plastic top on the base central projection, transfers weight placed on the middle of the cover directly to the base to greatly strengthen a stack of container.

Commonly, bundt containers containing cakes are stacked on one another. Applicant constructs the container to facilitate such stacking. The cover top is formed with a raised perimeter portion 80, or annular top rim portion, that is centered on the vertical axis 90. The rim portion has radially (with respect to axis 90) inner and outer corner rim walls 84, 86. As shown in FIG. 4, the base has an upwardly-opening recess bottom 82. A raised band portion or region 84 lies radially (with respect to axis 90) outside the recess 82. The base has largely vertical radially inner and outer band walls 100, 101. The band portion 84 and a slightly depressed portion 92 lie between primarily vertical inner and outer locating walls 100, 102 that defines an annular receiving space 104 between them. The raised portion 80 of a cover top lies in the receiving space, with radially inner and outer cover rim walls 86, 88 lying adjacent to the locating walls 100, 102. As a result, when many identical containers 10 are stacked on one another, portions of the stack cannot shift sidewardly. The annular receiving space 104 receives the raised perimeter portion 80 at any rotational position of a base on a cover, with the top of the raised perimeter portion lying against a lower surface 106 of the wall of the depressed portion 92.

When a bundt cake is placed on the base 14, the periphery of the cake usually lies on the band portion 84. The circular inner and outer edges of the band portion help a person to center the cake on the base, when the cake is initially being laid down and the cake is obscuring the central projection.

Figure 5:
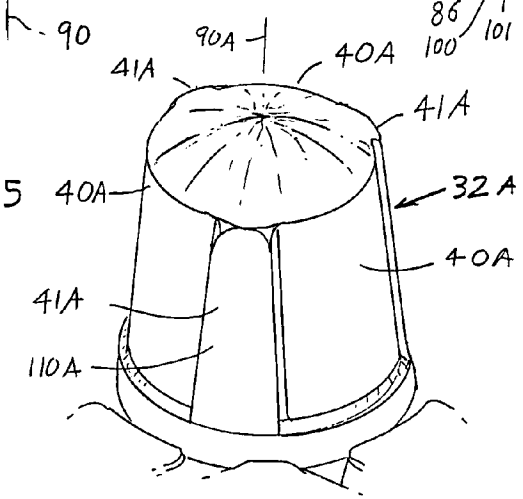
FIG. 5 is a partial isometric view of the base of a bundt cake container of another embodiment of the invention.

FIG. 5 illustrates a central projection 32A of another embodiment of the invention, wherein the projection has wide grooves 40A and only three primarily vertical lands 41A between the grooves, the lands having tapered upper ends. The lands form a peripheral surface 110A of the projection. Each land extends a plurality of degrees about the axis 90A to avoid cutting into the cake.

Figure 6:
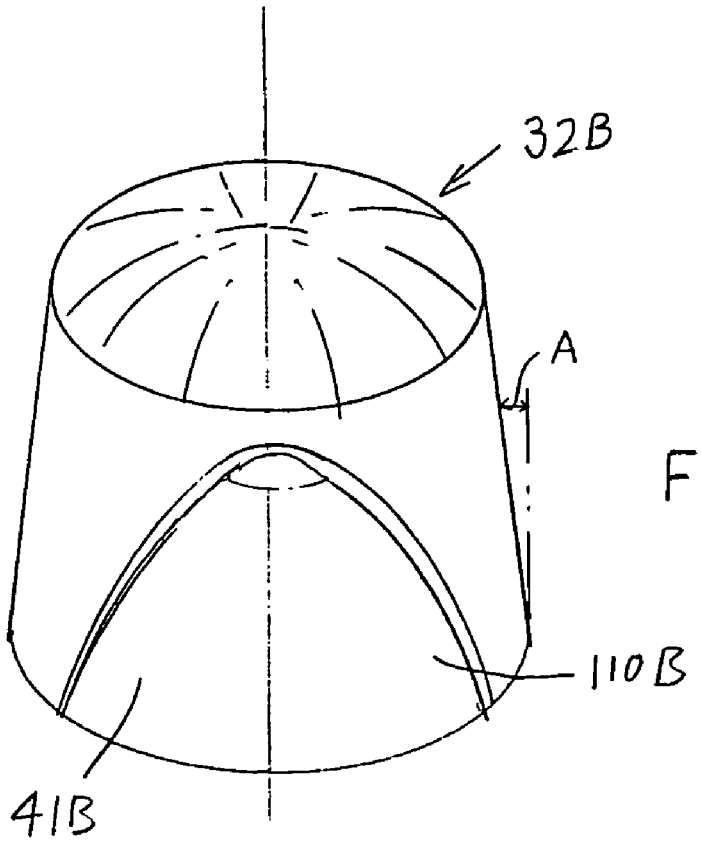
FIG. 6 is a partial isometric view of the central projection on the base of a bundt cake container of another embodiment of the invention.
Figure 7:
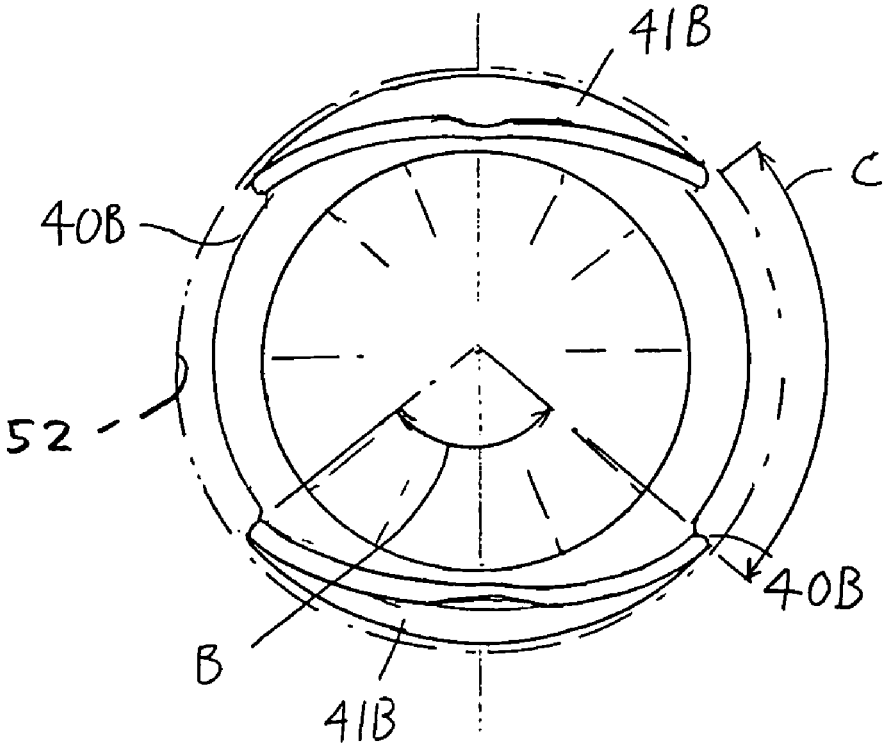
FIG. 7 is a plan view of the central projection of FIG. 6.

FIGS. 6 and 7 illustrate a central projection 32B of another embodiment of the invention, wherein the projection has two largely vertical lands 41B between two grooves 40B. The lower end 110B of each land subtends an angle B of about 110°. The upper end 112B of each land is inclined by at least twice the taper angle A to help in initially centering the hole 52 in the bundt cake. The lands form the peripheral surface 110B of the central projection, which engages the cake. The land lower portions are spaced apart by an angle C of no more than about 90°, the lands in FIG. 7 being spaced by angles C of 78°.

Thus the invention provides a bundt cake container that avoids the unsightly accumulation of frosting around the top of the cake central hole, and which strengthens the container when other containers are stacked thereon. The central projection on the base of the container, which projects into the hole at the center of the cake, is formed with a plurality of largely vertical grooves. The grooves could extend as part of a helix. The middle of the cover top is formed with a downwardly-extending post part that lies over the central projection on the base, and that bears against the projection when the cover top middle is depressed. The top of the central projection preferably has a depression that receives the lower end of the post part. The lower surface of the base peripheral portion forms an upwardly-extending space that receives a raised peripheral portion of the cover top to reliably stack identical containers on one another.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A container and a cake that has a central vertical hole, comprising:

a base which comprises a piece of plastic that has been formed with a cake-supporting surface with said cake lying thereon, said base having a rim portion and a central upward projection that projects upward into the hole in the cake, said projection having a top surface;

a cover which comprises a piece of plastic that has been formed with a primarily horizontal cover top wall and with cover side walls that have a bottom that holds to said rim portion;

said cover top wall is formed with a post part that is narrower than said upward projection and that projects a plurality of centimeters downward to lie against said top surface of said projection at least when the cover top wall is pushed down.

2. The container described in claim 1 wherein:

said post part has a diameter and has a vertical height that is greater than said diameter.

3. A container for holding a cake that has a central vertical hole, comprising:

a base which comprises a piece of plastic that has been formed with a cake-supporting surface, a rim portion, and a central upward projection for projecting into the hole in the cake, said projection having a top surface;

a cover which comprises a piece of plastic that has been formed with a primarily horizontal cover top wall and with cover side walls that have a bottom that holds to said rim portion;

said cover top wall is formed with a post part that projects downward to lie against said top surface of said projection at least when the cover top wall is pushed down;

said projection has a lower portion extending along most of the height of the projection and which is tapered so its sides extend at a first taper angle from the vertical, and said projection has an upper part of a height of at least one centimeter which is tapered so its sides extend at a second taper angle to the vertical that is at least twice said first taper angle.

* * * * *